US007146886B1

(12) United States Patent
Wu

(10) Patent No.: US 7,146,886 B1
(45) Date of Patent: Dec. 12, 2006

(54) WRENCH CAPABLE OF QUICK REPLACEMENT OF SWIVEL DRIVING MEMBERS

(75) Inventor: Arthur Wu, Taichung Hsien (TW)

(73) Assignee: Proxene Tools Co., Ltd., Taichung (TW)

( * ) Notice: Subject to any disclaimer, the term of this patent is extended or adjusted under 35 U.S.C. 154(b) by 0 days.

(21) Appl. No.: 11/320,666

(22) Filed: Dec. 30, 2005

(51) Int. Cl.
*B25B 23/16* (2006.01)

(52) U.S. Cl. ..... 81/177.8; 81/177.9; 81/177.7; 81/124.6

(58) Field of Classification Search ..... 81/177.8, 81/177.9, 177.7, 124.6
See application file for complete search history.

(56) References Cited

U.S. PATENT DOCUMENTS

| | | | | |
|---|---|---|---|---|
| 4,541,310 | A * | 9/1985 | Lindenberger | 81/60 |
| 4,581,959 | A | 4/1986 | Troiano | |
| 4,711,145 | A | 12/1987 | Inoue | |
| 5,199,335 | A | 4/1993 | Arnold et al. | |
| 5,768,960 | A | 6/1998 | Archuleta | |
| 6,000,302 | A | 12/1999 | Chiang | |
| 6,295,898 | B1 | 10/2001 | Hsieh | |
| 6,336,383 | B1 * | 1/2002 | Hung | 81/60 |
| 6,382,058 | B1 * | 5/2002 | Owoc | 81/177.9 |
| 6,397,709 | B1 * | 6/2002 | Wall | 81/440 |
| D506,373 | S | 6/2005 | Hsien | |
| 2004/0144219 | A1 | 7/2004 | Lin | |

FOREIGN PATENT DOCUMENTS

| | | |
|---|---|---|
| TW | 482064 | 4/2002 |
| TW | 497526 | 8/2002 |

* cited by examiner

*Primary Examiner*—Joseph J. Hail, III
*Assistant Examiner*—Shantese L. McDonald
(74) *Attorney, Agent, or Firm*—Birch, Stewart, Kolasch & Birch, LLP

(57) ABSTRACT

A wrench includes a handle and a set of driving members to be selected to be coupled to the handle. Each of the driving members has a connecting portion complementary to the connecting portion of the handle. A coupling device is disposed at the connecting portion of the handle to detachably coupling the connecting portion of the driving member and the connecting portion of the handle. The coupling device forms a rotation axis of the driving member, such that the driving member can rotate. As a result, the driving members can be replaced quickly to the handle to meet the specific work.

26 Claims, 10 Drawing Sheets

WRENCH CAPABLE OF QUICK REPLACEMENT OF SWIVEL DRIVING MEMBERS

BACKGROUND OF THE INVENTION

1. Field of the Invention

The present invention relates generally to a hand tool, and more particularly to a wrench, which has various driving members for replacement and the driving member mounted on the wrench can adjust the angle thereof.

2. Description of the Related Art

Conventional wrenches are classified into double open-end wrench, double close-end wrench, combination wrench, ratchet wrench, sock wrench, adjustable wrench, and so on. These wrenches have same function and have specific functions respectively.

The combination wrench only drives a single size of nut or bolt, such that there always are dozens of combination wrenches (or double open-end wrenches, double close-end wrenches, or ratchet wrenches) in a tool box. These wrenches have a handle and two drive-ended members integrated at two ends of the handle, which it cannot replaces drive-ended members.

The socket wrench has a ratchet wrench and a set of sockets. The ratchet wrench has a square driving end to be detachably engaged with the sockets for driving the bolts or nuts of different sizes. The wrench may be able to adjust the angle of the driving end for a narrow space (e.g. working in the engine room of a car). Such wrench provides a universal joint between the driving end and the socket, and it is difficult to operate. There are some socket wrenches equipped with universal sockets, but the higher cost makes it rare in the market. In addition, the sock is close at a bottom end, such that it cannot drive the hexagonal jointer of the pipe.

Adjustable wrench is manipulative to move the movable jaw to adjust the distance between the movable jaw and the fixed jaw, such that it can drive bolts (or nuts) with different sizes.

The conventional wrenches have some capable of adjusting the angle of the driving end (or fixing the driving end at a predetermined angle). Such inventions include U.S. Pat. No. D506,373, 4,581,959, 5,768,960, 6,295,898, 6,000,302, 5,199,335, and 4,711,145, 2004/0144219. These inventions taught wrenches capable of adjusting the angle of the driving end and/or fixing the driving end at a predetermined angle, but quick replacement of driving members.

Some inventions taught wrenches capable of adjusting the angle of the driving end, such as Taiwan Pat. Publication No. 482064, which FIG. 1 shows the wrench may replace the driving members but adjust the angle along Z axis. Taiwan Pat. Publication No. 497526 taught a wrench with a threaded shaft to couple the driving member and the handle. It has a higher cost and needs longer time to replace the driving members. The threaded shaft may rotate invalidly when the user exerted a greater power on the shaft. Another Taiwan Patent taught a wrench capable of both replacement of driving member and adjustment of angle, but they are independent. Such wrench has drawbacks of high cost and difficult to assemble.

SUMMARY OF THE INVENTION

The primary objective of the present invention is to provide a wrench, which is capable of replacement of driving members and adjustment of the angle of the driving member.

According to the objective of the present invention, a wrench comprises a handle having a connecting portion at an end thereof and a set of driving members to be selected to be coupled to the handle. Each of the driving members has a driving device and a connecting portion, and the connecting portions of the driving members are complementary to the connecting portion of the handle. A coupling device is disposed at the connecting portion of the handle to detachably coupling the connecting portion of the driving member and the connecting portion of the handle. The coupling device forms a rotation axis of the driving member, such that the driving member can rotate.

The wrench of the present invention further can be provided with a locking device disposed at the handle to secure the coupling device, such that the driving member is secured on the handle, and to release the coupling member, such that the driving member is free to be moved out of the handle.

DETAILED DESCRIPTION OF THE INVENTION

Figure 1:
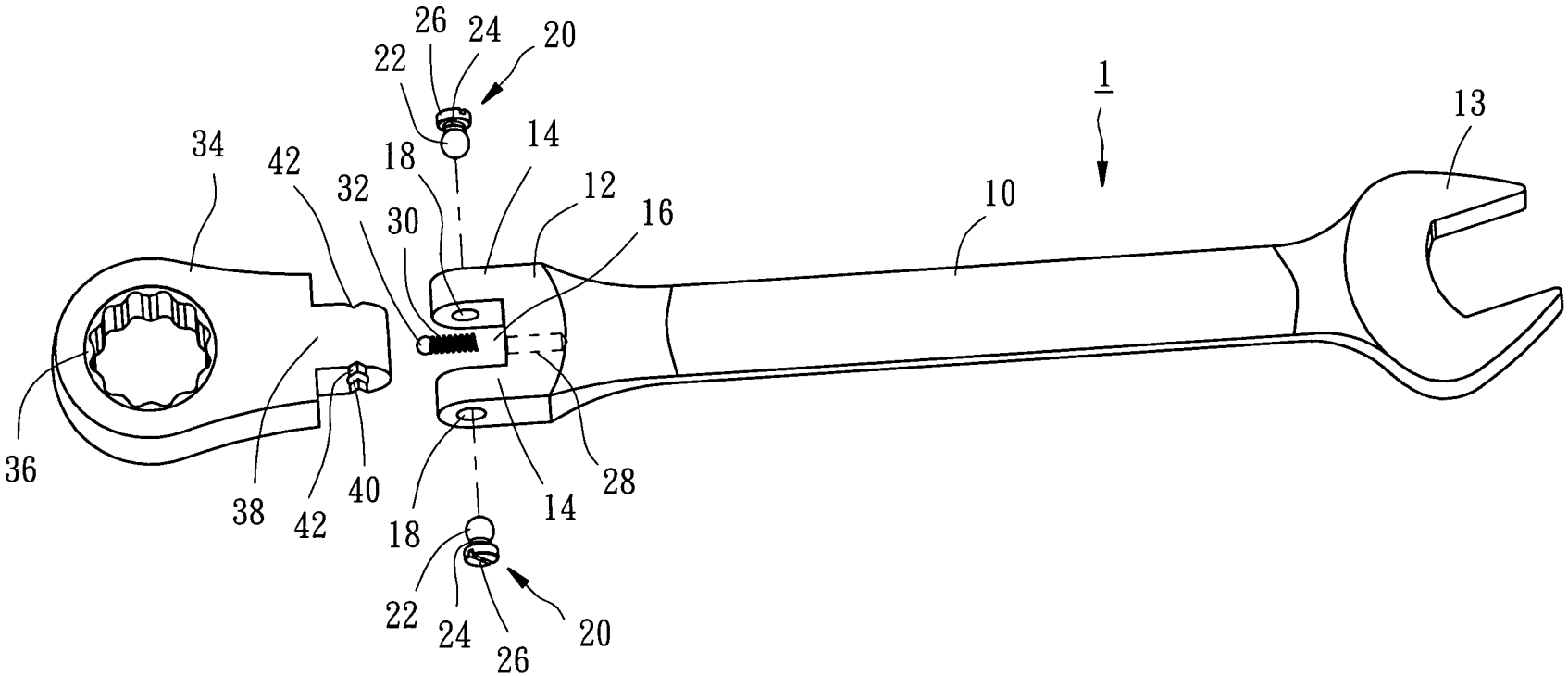
FIG. 1 is an exploded view of a first preferred embodiment of the present invention.
Figure 2:
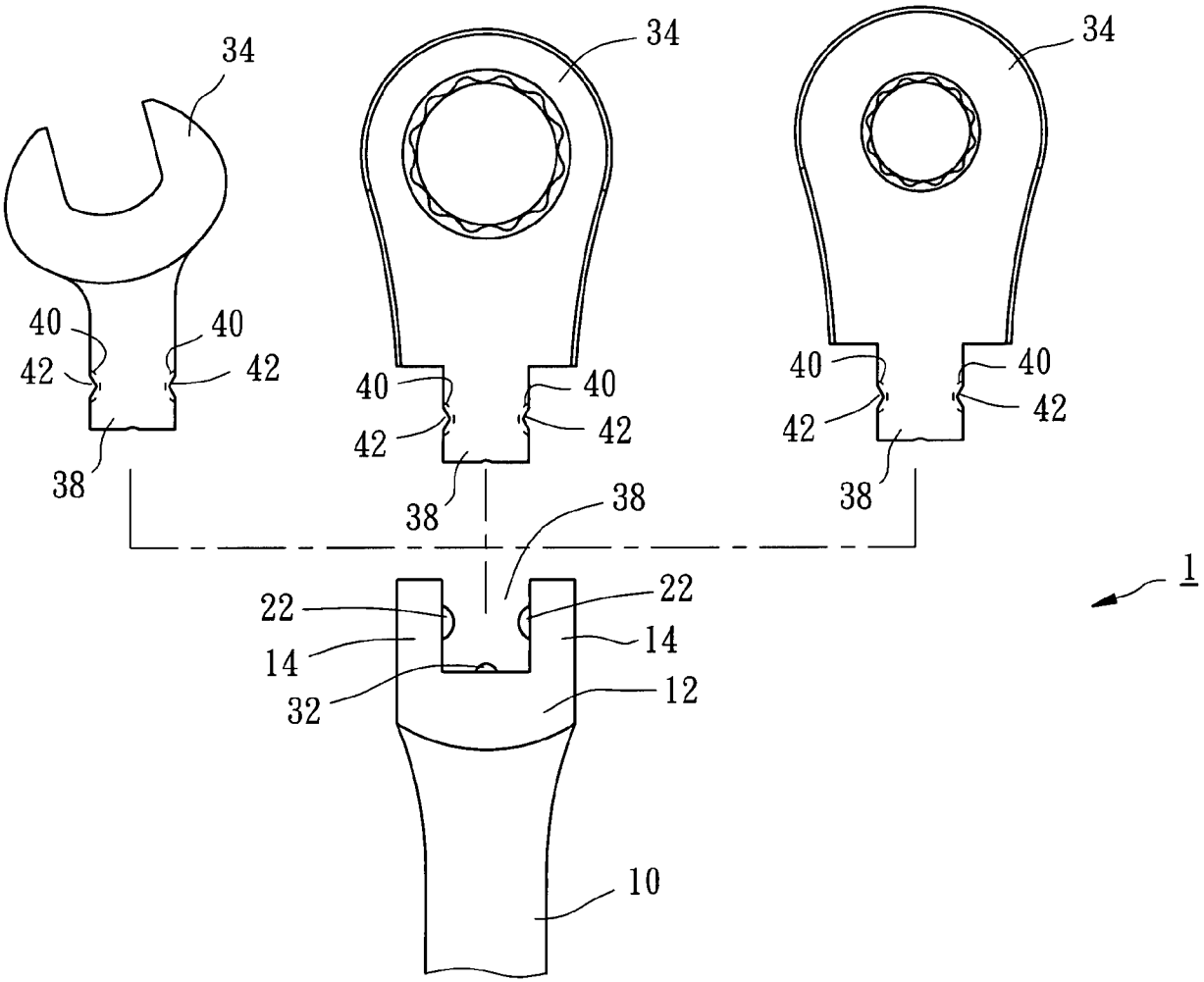
FIG. 2 is a top view of the first preferred embodiment of the present invention.

As shown in FIG. 1 and FIG. 2, a wrench 1 of the first preferred embodiment of the present invention includes a handle 10 and a set of driving members 34 for replacement.

The handle 10 has a connecting portion 12 at an end thereof and an open-end driving member 13 at opposite end. The connecting portion 12 has two parallel arms 14 and a space 16 between the arms 14. Each of the arms 14 has a bore 18 aligned with each other. In the bores 18 of the connecting portion 12 are a coupling device 20, which includes a ball 22, a spring 24 and a threaded column 26. The balls 22 have a portion extruded out of the bores 18 and received in the space 16, and the springs 24 urge the balls 22 respectively to keep the ball at those positions. The ends of the bores 18, which are adjacent to the space 16, have a diameter less than that of the balls 22, such that the balls 22 will not run out of the bores 18. The connecting portion 12 further is provided with a spring 30 and a ball 32 in a hole 28 at a bottom of the space 16.

Each driving member 34 has a driving device 36 and a connecting portion 38 at an end of the driving device 36. The driving device 36 may be open-end type, close-end type, adjustable wrench type, ratchet wrench type or other types and may have different sizes. The connecting portions 38 of the driving members 34 are a post with a width slightly less than that of the space 16 of the handle 10, such that the driving member 34 may be engaged with the handle 10 by means of inserting the connecting portion 38 of the driving member 34 into the space 16 of the connecting portion 12 of the handle 10. The connecting portion 38 of the driving member 34 is provided with a recess 40 at opposite sides respectively to receive the balls 22 of the coupling device 20. The connecting portion 38 is provided with a slot 42 at the opposite sides communicated with the recesses 40 respectively, such that the balls 22 may slide to recesses 40 along the slots 42 respectively. The recesses 40 have a depth greater than that of the slots 42.

To quick couple the driving member 34 to the handle 10, the slots 42 of the driving member 34 are aligned with the balls 22 to slide the balls 22 to the recesses 40. The driving member 34 may be coupled to the handle 10 by inserting the connecting portion 38 of the driving member 34 into the space 16 of the connecting portion 12 of the handle 10. To release the driving member 34, it only needs to pull the driving member 34 out. It is easy to know that the wrench of the present invention may replace the driving members quickly.

Figure 3:
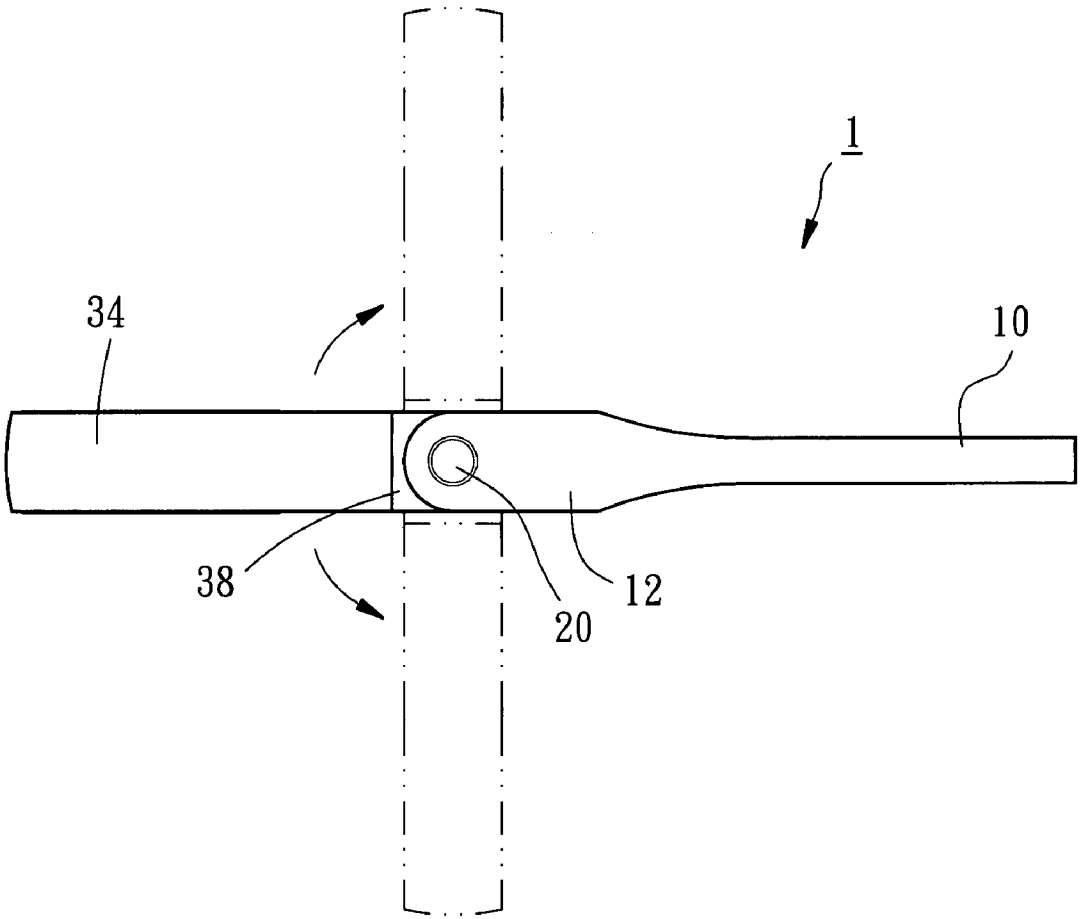
FIG. 3 is a lateral view of the first preferred embodiment of the present invention, showing turning of the driving member.

Except for coupling the driving member 34 to the handle 10, the coupling device 20 also forms a rotation axle for the driving member 34 to rotate the driving member 34 freely, as shown in FIG. 3.

With the wrench of the present invention, there may be only a handle and a set of driving members in the tool box. User may mount the specific driving member on the handle to do the specific work.

Figure 4:
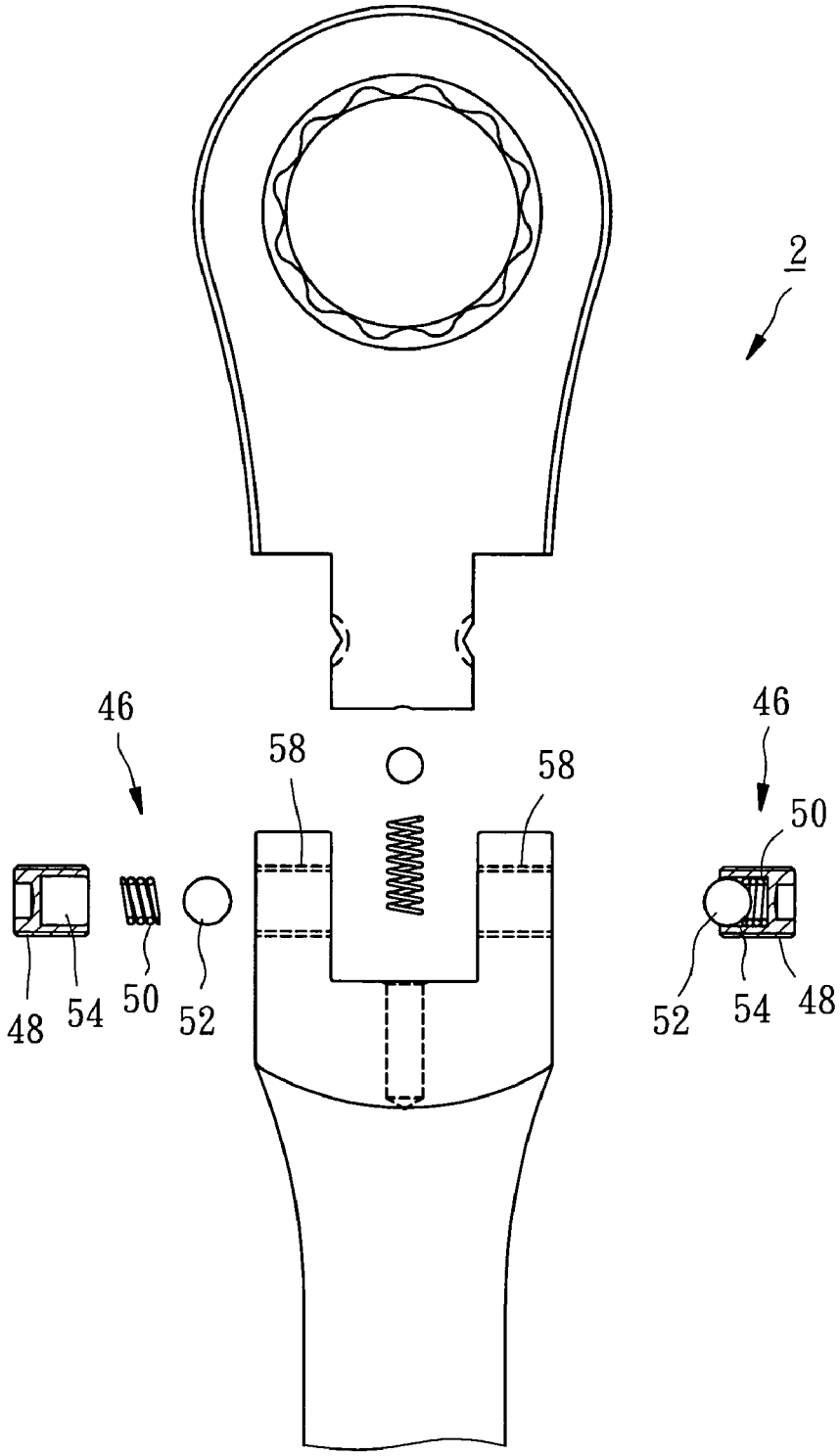
FIG. 4 is an exploded view of a second preferred embodiment of the present invention.

FIG. 4 shows a wrench 2 of the second preferred embodiment of the present invention, which is similar to the wrench 1 of the first preferred embodiment, except that a coupling device 46 has a base 48, a spring 50 and a ball 52. The base 48 has a slot 54 to receive the spring 50 and the ball 52 therein. The base 48, the spring 50 and the ball 52 are integrated as a module, and such module may be bought in the market easily. The coupling devices 46 may be screwed into bores 58 of the handle 56 directly to simplify the assembling process.

Figure 5:
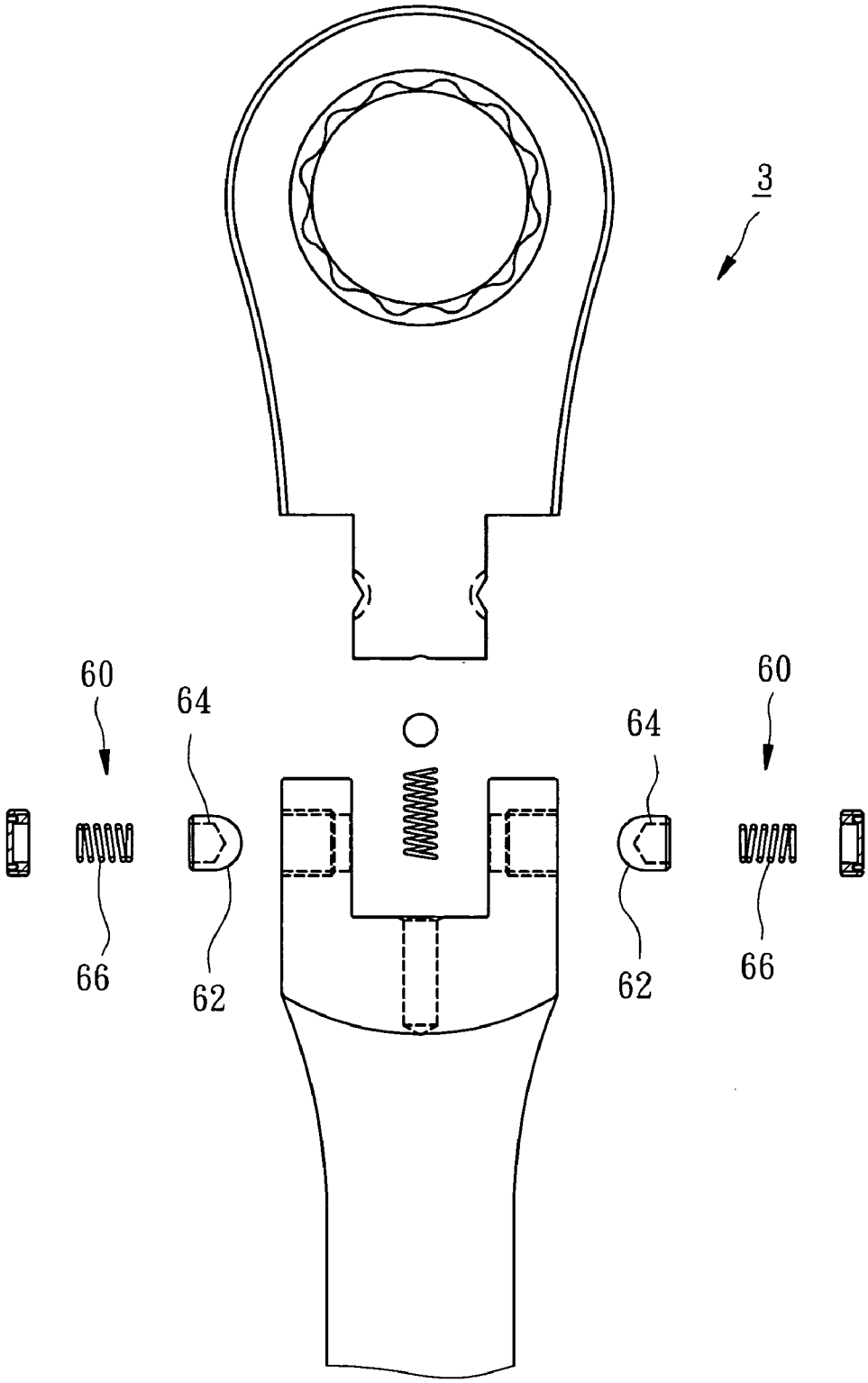
FIG. 5 is an exploded view of a third preferred embodiment of the present invention.

FIG. 5 shows a wrench 3 of the third preferred embodiment of the present invention, which is similar to the wrench 1 of the first preferred embodiment, except that a coupling device 60 has a block 62 with a convex end for replacement of the ball. The block 62 has a slot 64 at a rear end to receive an end of a spring 66.

Figure 6:
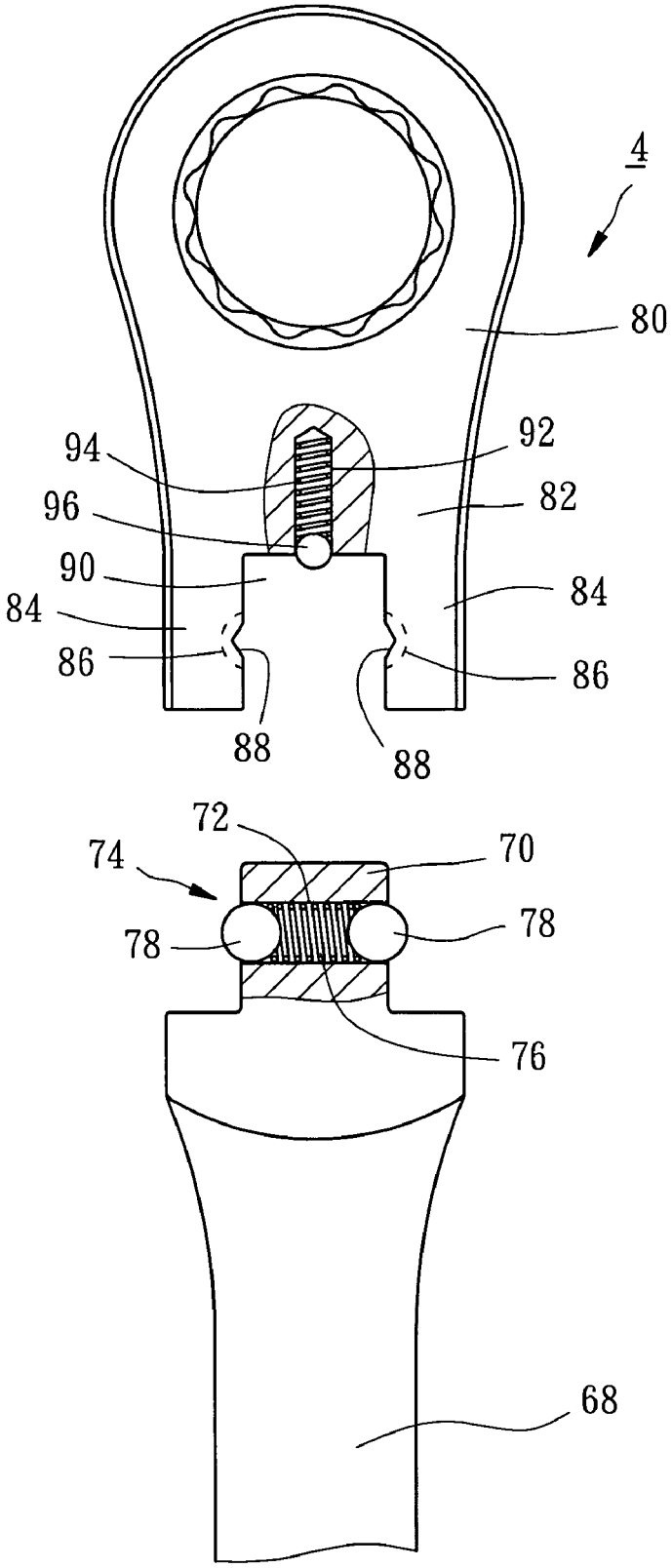
FIG. 6 is an exploded view of a fourth preferred embodiment of the present invention.

FIG. 6 shows a wrench 4 of the fourth preferred embodiment of the present invention, which includes a handle 68 with two post-like connecting portions 70 at opposite ends and a set of driving members 80 with a U-shaped connecting portion 82 respectively. The connecting portion 70 of the handle 68 has a transverse hole 72, in which a coupling device 70 is received. The coupling device 70 includes a spring 76 and two balls 78. The springs 76 has opposite ends urging the balls 78 to keep the balls 78 having a portion extruded out of the hole 72. The connecting portion 82 of the driving member 80 has two parallel arms 84 with a recess 86 and a slot 88 at an interior sides respectively and a space 90 between the arms 84. The connecting portion 82 is provided with a spring 94 and a ball 96 in a hole 92 at a bottom of the space 90. The way of replacing the driving members is as same as above embodiment, so I do not describe it again.

Figure 7:
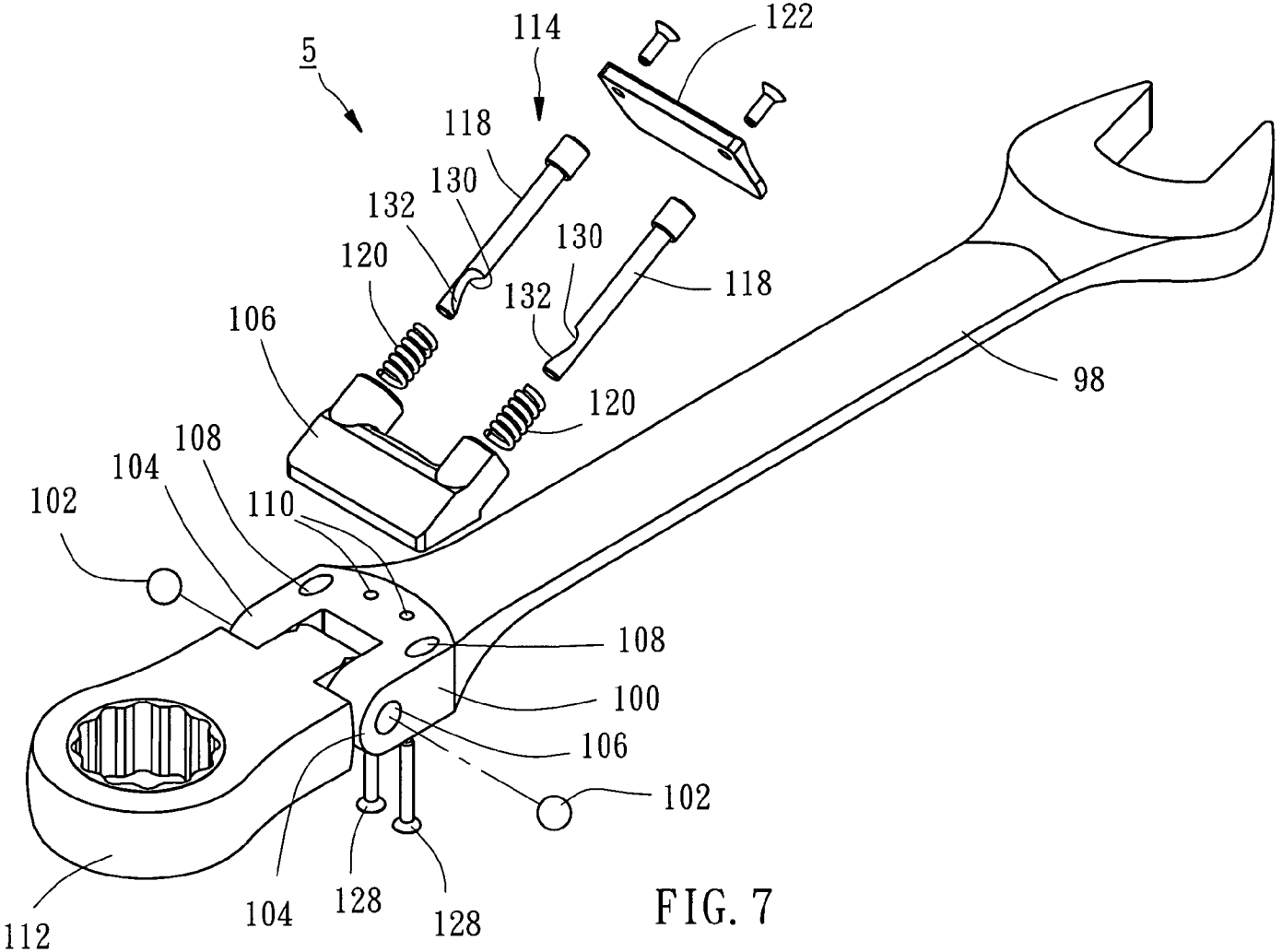
FIG. 7 is an exploded view of a fifth preferred embodiment of the present invention.
Figure 8:
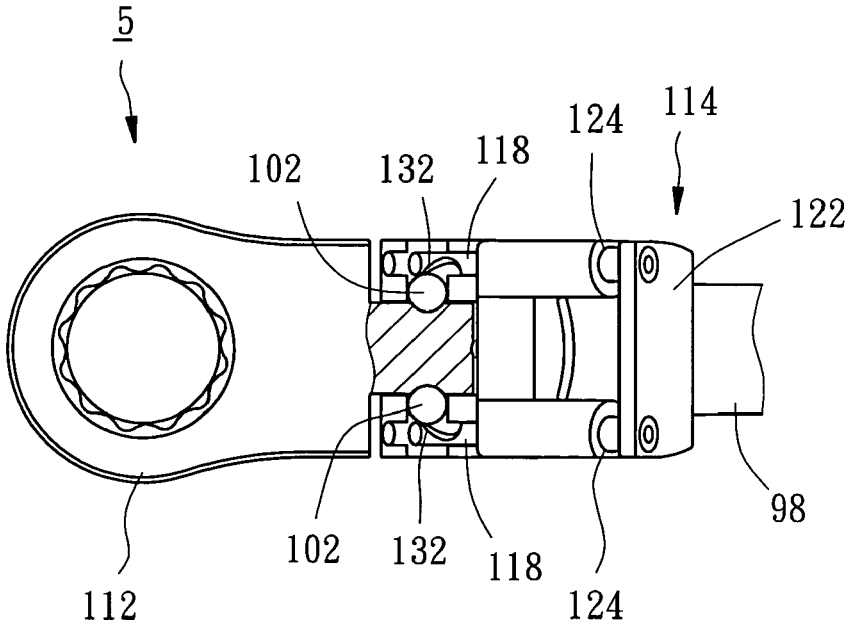
FIG. 8 and FIG. 9 are top views of the fifth preferred embodiment of the present invention, showing the driving member unlocked and locked by the control device.

FIG. 7 shows a wrench 5 of the fifth preferred embodiment of the present invention, which includes a handle 98 with a connecting portion 100 at an end thereof and a coupling device 102, which has two balls, mounted on the connecting portion 100. The connecting portion 100 has two parallel arms 104 with a bore 106 respectively, and the balls 102 are received in the bores 106. The connecting portion 100 is provided with two inclined holes 108 on a top thereof extending to the bores 106 respectively and two fixing holes 110 extending from the top to a bottom. A set of driving members 112 (only show one driving member in the drawing), which are as same as the driving members 34 of the first preferred embodiment, are selected to mount on the handle 98 or release from the handle 98. The wrench 5 further comprises a control device 114, which includes a base 116, two shafts 118, two springs 120 and a plate 122. The base 116 has two inclined through holes 124 (referring to FIG. 8) extending from a top to a bottom and two threaded holes (not shown) on the bottom. The base 116 is placed on the top of the connecting portion 100 of the handle 98, and two bolts 128 are inserted into the fixing holes 110 and screwed into the threaded holes of base 116 to fix the base 116 on the handle 98. The springs 120 and the shafts 118 are received in the through holes 124 of the base 116 respectively. Each of the shafts 118 has a small dimension section inserted into the inclined holes 108 of the handle 98 and a greater dimension section left out of the base 116, and the plate 122 is fixed to the ends of the greater dimension sections of the shafts 118. User may press the plate 122 to move the shafts 118 inwards, and the springs 120 may return the shafts 118 when user releases the plate 122. Each of the shafts 118 has a recess 130 and a sloping portion 132 beside the recess 130.

Figure 9:
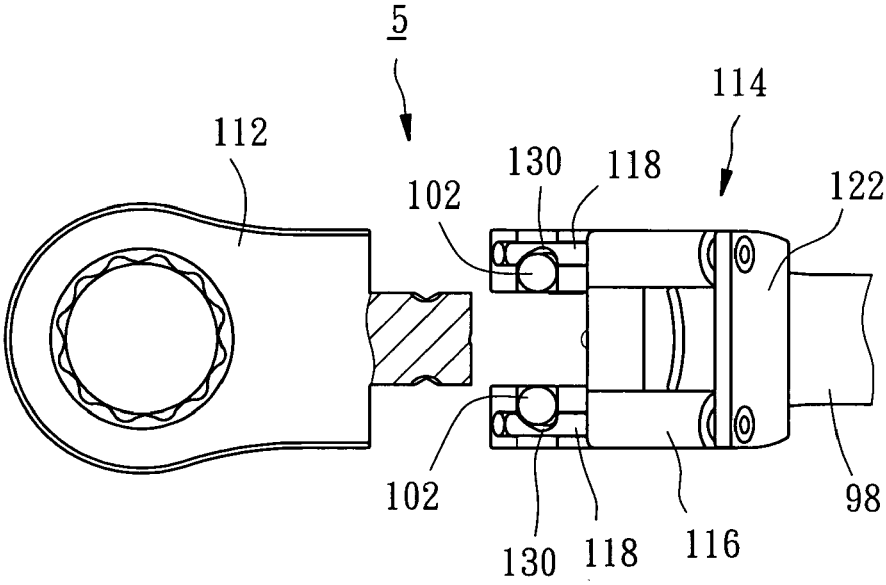

To replace the driving member 112, user has to press the plate 112 to move the shafts 118 inwards. In the meantime, the recesses 130 of the shafts 118 are moved to backs of the balls 102 to provide a space for the balls 102 totally received in the bores 106 (referring to FIG. 9), such that the driving member 112 may be easily pulled out and install another driving member 112. And then, user may release the plate 122 to force the balls 102 extruded out of the bores 106 because the sloping portions 132 of the shafts 118 are moved to the backs of the balls 102. As a result, the driving member 112 will be locked by the balls 112.

Figure 10:
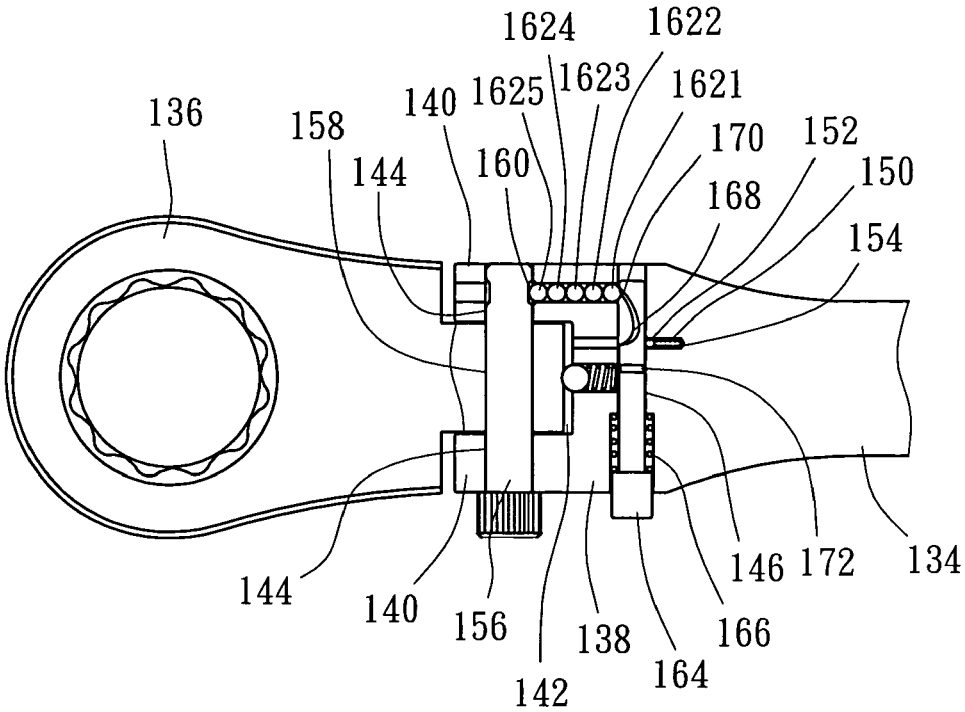
FIG. 10 and FIG. 11 are top views of a sixth preferred embodiment of the present invention, showing the driving member unlocked and locked by the control device.
Figure 11:
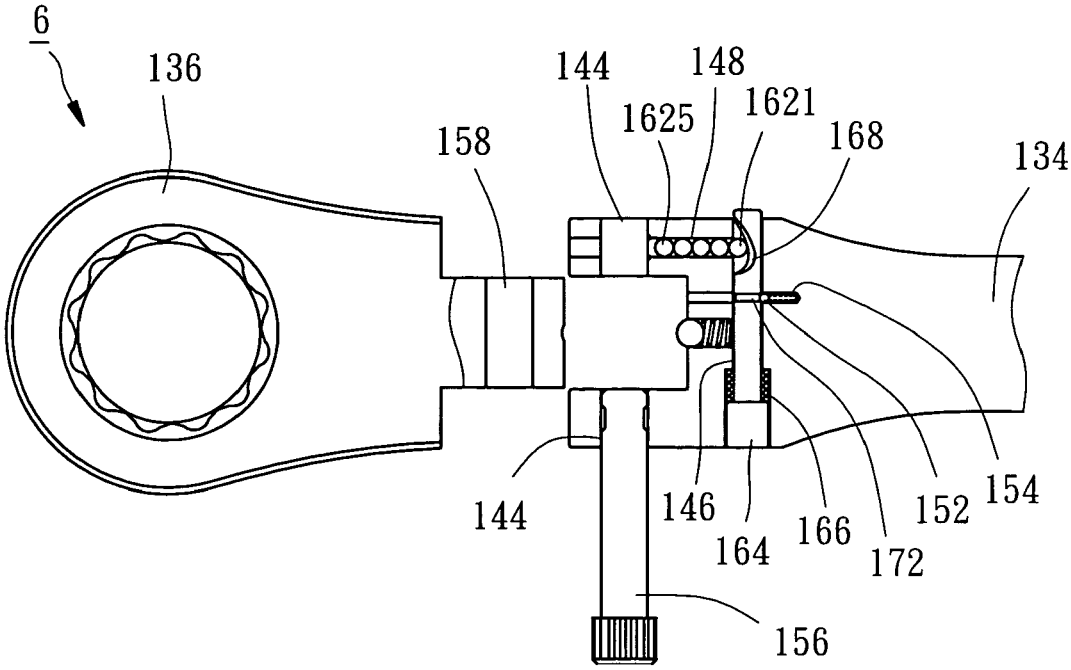

As shown in FIG. 10 and FIG. 11, a wrench 6 of the sixth preferred embodiment of the present invention includes a handle 134 and a set of driving members 136 (only show one driving member in drawing) foe replacement. The handle 134 has a connecting portion 138 at an end thereof with two parallel arms 140 and a space 142 between the arms 140. The arms 140 are provided with a bore 144 aligned with each other. The connecting portion 138 is provided with a hole 146, which is parallel to the bore 144, behind the arms 140 and a tunnel 148 communicating the hole 146 and the bore 144 of one arm 140. The connecting portion 138 further is drilled with a hole 150 at a bottom of the space 142 and crossing the hole 146, in a bottom of which a ball 152 and a spring 154 are installed. A coupling device 156, which is a shaft, is inserted into the bores 134 of the connecting portion 138 and a through hole 158 of the driving member 136 to couple the driving member 136 to the handle 134. The shaft 156 has an annular slot 160 aligned with the tunnel 148. Five balls 1621~1625 are received in the tunnel 148. A shaft 164 and a spring 166 are received in the hole 146, wherein the shaft 164 has a recess 168, a sloping portion 170 beside the recess 168, and a slot 172.

FIG. 10 shows a driving member 136 coupled to the handle 134, in which the sloping portion 170 of the shaft 164 pushes the ball 1625 to move a portion of the ball 1621 extruded out of the tunnel 148 and entering the slot 160 of the shaft 156, such that the shaft 156 is locked by the ball 1621 and the driving member 136 is fixed to the handle 134 firmly. When press the shaft 164, referring to FIG. 11, the slot 172 is moved to the ball 152 and the recess 172 is move to the ball 1625. The ball 152 enters the slot 172 to position the shaft 164 thereat, and the ball 1625 will drop in the recess 172 to move the ball 1621 out of the slot 160 of the shaft 156, such that user may pull the driving member 136 out and replace another driving member 136. When the new driving member 136 is inserted into the space 142 of the connecting portion 138 of the handle 134, user may press the shaft 164 along the opposite direction to move the shaft 164 back. User has to exert a little power on the shaft 164 to overcome the restriction of the ball 152 and the slot 172 and the spring 166 will take over. After the shaft 164 moves, the sloping portion 170 will push the ball 1625 to move the ball 1621 into the slot 160 of the shaft 156, such that the driving member 136 will be locked.

It has to be mentioned that the ball 1625 always has a portion received in the recess 168 of the shaft 164 to prevent the shaft 164 from escaping out of the hole 146.

Figure 12:
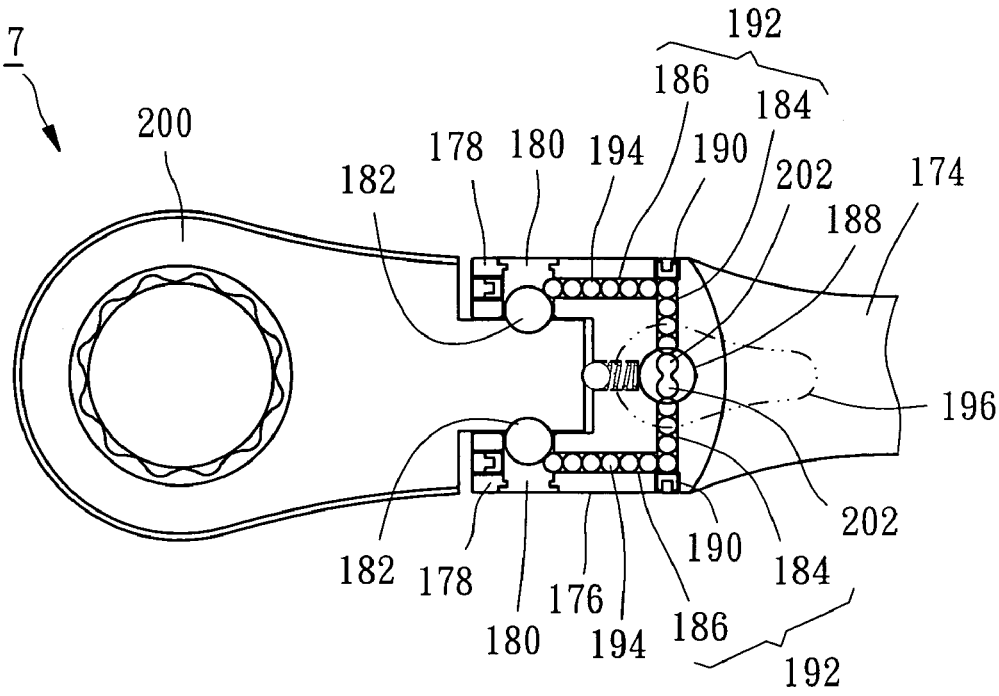
FIG. 12 and FIG. 13 are top views of a sixth preferred embodiment of the present invention, showing the driving member locked and unlocked by the control device.
Figure 13:
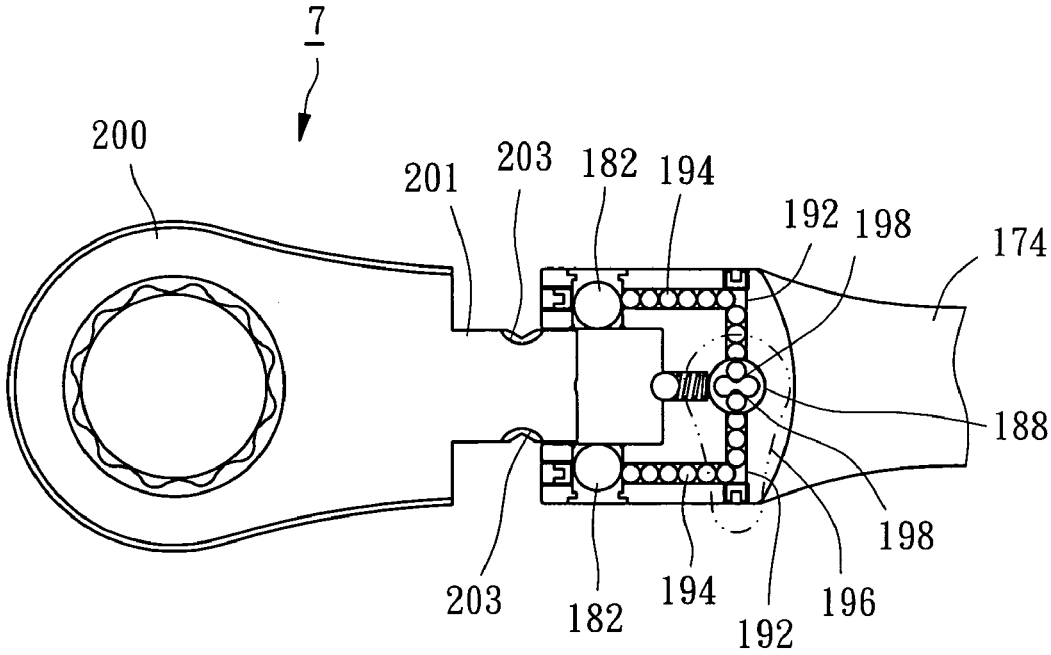

As shown in FIG. 12 and FIG. 13, a wrench 7 of the seventh preferred embodiment of the present invention includes a handle 174 with a U shaped connecting portion 178. The connecting portion 178 has two arms 178, each of which has a bore 180 and a coupling device 182, which is a ball, received in the bore 180. The connecting portion 178 further has a hole 184 behind the arms 178 and parallel to the bores 180 and two tunnels 186 communicating the bores 180 and the hole 184 respectively. The connecting portion 178 is drilled with an aperture 188 at a top thereof extending to the hole 184, in which a cam device 196 is received. Two posts 190 are inserted into two ends of the hole 184, such that two L-shaped channels 192 are formed at opposite sides of the cam device 196. Balls 194 are received in the channels 192 respectively, and the series of the balls are in touch with the cam device 196 and the balls of the coupling devices 182 respectively.

The cam device 196 has two convex portions 202 and two concave portions 198. When the cam device 196 is turned with the convex portions 202 against the balls 194, referring to FIG. 12, the convex portions 202 will move the balls 194 outwards to force the balls of the coupling devices 182 extruding out of the bores 180, such that the coupling devices 182 can lock a driving member 200 on connecting portion 178 of the handle 176.

When the cam device 196 is turned with the concave portions 198 against the balls 194, referring to FIG. 13, the balls 194 may move back into the channel 192, and the balls of the coupling devices 182 can be moved back into the bores 180, such that the driving member 200 is unlocked, and user may pull it out for replacement.

What is claimed is:

1. A wrench, comprising:

a handle having a connecting portion at an end thereof;

a set of driving members to be selected to be coupled to the handle, each of which has a driving device and a connecting portion, wherein the connecting portions of the driving members are complementary to the connecting portion of the handle;

a coupling device disposed at the connecting portion of the handle to couple the connecting portion of the driving member and the connecting portion of the handle, wherein the coupling device forms a rotation axis of the driving member, such that the driving member can rotate; and a locking device disposed at the handle, wherein the locking device is moved toward the coupling device to fix the coupling device, such that the coupling device secures the driving member on the handle, and the locking device is moved away from the coupling device, such that the driving member is free to be moved out of the handle.

2. The wrench as defined in claim 1, wherein the locking device has a shaft with a recess and a sloping portion, and the shaft is moved to a position where the recess is aligned with the coupling device to receive the coupling device in the recess and to release the driving member and a position where the sloping portion is aligned with the coupling device to move the coupling device outwards and to lock the driving member.

3. The wrench as defined in claim 2, wherein the coupling device has a ball.

4. The wrench as defined in claim 2, wherein the connecting portion of the handle has two substantially parallel arms and a space between the arms, and each of the arms has a bore, in which the coupling device is received, and the connecting portion of the handle is provided with a hole extending to the bore in which the shaft is received.

5. The wrench as defined in claim 2, wherein the locking device has a spring urging the shaft to the position where the sloping portion is aligned with the coupling device.

6. The wrench as defined in claim 5, wherein the locking device further comprises a base fixed on the handle, which has a hole aligned with the hole on the handle, and the shaft is received in both of the holes of the base and the handle, and the spring is received in the hole of the base.

7. The wrench as defined in claim 6, wherein the locking device further comprises a plate fixed to an end of the shaft.

8. The wrench as defined in claim 1, wherein the locking device has a shaft with a recess and a sloping portion and a plurality of balls lined between the coupling device and the shaft, and the shaft is moved to a position where the recess is aligned with the balls to receive the balls in the recess and to release the driving member and a position where the sloping portion is aligned with the balls to move the balls outwards and to lock the driving member.

9. The wrench as defined in claim 8, wherein the connecting portion of the handle is provided with a bore, in which the coupling device is received, a hole, in which the shaft is received, and a tunnel communicating the bore and the hole, in which the ball is received.

10. The wrench as defined in claim 9, wherein the handle is provided with a hole, in which a ball and a spring are received, and the shaft has a slot, whereby the shaft is moved to a position where the ball can enter the slot to position the shaft thereat.

11. The wrench as defined in claim 9, wherein the coupling device has a shaft to be inserted into the bores of the connecting portion of the handle and a through hole of the connecting portion of the driving member, and the shaft has a slot to receive the balls when the sloping portion of the shaft moves the balls outwards.

12. The wrench as defined in claim 1, wherein the locking device has a cam device and a plurality of balls lined between the cam device and the coupling device, wherein the cam device is turned to force the balls toward the coupling device to lock the driving member on the handle.

13. The wrench as defined in claim 12, wherein the connecting portion of the handle is provided with an aperture, in which the cam device is received for free rotation, and a channel communicating the aperture and the bore, in which the balls are received.

14. The wrench as defined in claim 13, wherein the coupling device has a ball.

15. The wrench as defined in claim 13, wherein the channel has a hole extending to the aperture and a tunnel with opposite end communicated with the hole and the bore.

16. A wrench, comprising:

a handle having a connecting portion at an end thereof;

a set of driving members to be selected to be coupled to the handle, each of which has a driving device and a connecting portion, wherein the connecting portions of the driving members are complementary to the connecting portion of the handle; and a coupling device disposed at the connecting portion of the handle, which includes two balls and spring means urging the balls toward the driving member, such that the coupling device couples the driving member to the handle when the connecting portion of the driving member is fitted to the connecting portion of the handle, and the balls form a rotation axis, such that the driving member can rotate.

17. The wrench as defined in claim 16, wherein the connecting portion of the handle includes two substantially parallel arms, each of which has a bore, and a space between the arms, and the balls and the spring means of the coupling device are received in the bores.

18. The wrench as defined in claim 17, wherein the coupling device further includes two bases received in the bores of the handle, each of which has a slot to receive the ball and the spring means.

19. The wrench as defined in claim 16, wherein the connecting portion of the handle has a post with a through hole, and the balls and the spring means of the coupling device are received in the through hole of the handle, in which the spring means have opposite ends urging the balls.

20. The wrench as defined in claim 16, wherein the connecting portion of the driving member has two recesses to receive the balls of the coupling device when the driving member is fitted to the handle.

21. The wrench as defined in claim 16, wherein the connecting portion of the driving member further includes two slots communicated with the recesses.

22. A wrench, comprising:

a handle having a connecting portion at an end thereof;

a set of driving members to be selected to be coupled to the handle, each of which has a driving device and a connecting portion, wherein the connecting portions of the driving members are complementary to the connecting portion of the handle; and a coupling device disposed at the connecting portion of the handle, which includes two blocks and spring means urging the blocks toward the driving member, such that the coupling device couples the driving member to the handle when the connecting portion of the driving member is fitted to the connecting portion of the handle, and the blocks form a rotation axis, such that the driving member can rotate;

wherein each of the blocks includes a convex portion and a slot at opposite ends, and the spring means have ends received in the slots of the blocks.

23. The wrench as defined in claim 22, wherein the connecting portion of the handle includes two substantially parallel arms, each of which has a bore, and a space between the arms, and the blocks and the spring means of the coupling device are received in the bores.

24. The wrench as defined in claim 23, wherein the coupling device further includes two bases received in the bores of the handle, each of which has a slot to receive the block and the spring means.

25. The wrench as defined in claim 22, wherein the connecting portion of the driving member has two recesses to receive the convex portions of the blocks of the coupling device when the driving member is fitted to the handle.

26. The wrench as defined in claim 22, wherein the connecting portion of the driving member further includes two slots communicated with the recesses.

* * * * *